United States Patent [19]

Ostroski et al.

[11] Patent Number: 4,666,027

[45] Date of Patent: May 19, 1987

[54] COIN VALIDATION APPARATUS AND METHOD FOR DETECTING STRINGING OF COINS AND DISTINGUISHING VALID TOKENS OR COINS FROM SLUGS

[75] Inventors: Joseph Ostroski; Lawrence M. Briski, both of Phoenix, Ariz.

[73] Assignee: Validation Systems, Inc., Phoenix, Ariz.

[21] Appl. No.: 827,798

[22] Filed: Feb. 7, 1986

[51] Int. Cl.[4] ..... G07F 3/02

[52] U.S. Cl. ..... 194/203; 194/200; 194/318; 194/334; 194/344; 194/350; 193/DIG. 1; 49/35

[58] Field of Search ..... 194/203, 318, 334, 344, 194/200, 202, 350, 353; 193/32, DIG. 1; 49/35

[56] References Cited

U.S. PATENT DOCUMENTS

| | | | |
|---|---|---|---|
| 3,285,382 | 11/1966 | Williams III | 194/10 |
| 3,741,363 | 6/1973 | Hinterstocker | 194/318 |
| 3,933,232 | 1/1976 | Searle et al. | 194/318 |
| 3,998,309 | 12/1976 | Mandas et al. | 194/97 |
| 4,106,610 | 8/1978 | Heiman | 194/97 |
| 4,243,133 | 1/1981 | Nicolaus | 194/9 |
| 4,267,916 | 5/1981 | Black et al. | 194/102 |
| 4,298,116 | 11/1981 | Niemeyer | 194/97 |
| 4,413,718 | 11/1983 | Dean | 194/344 |
| 4,437,558 | 3/1984 | Nicholson et al. | 194/97 |
| 4,441,602 | 4/1984 | Ostroski et al. | 194/318 |
| 4,483,431 | 11/1984 | Pratt | 194/334 X |
| 4,509,633 | 4/1985 | Chow | 194/334 |
| 4,546,868 | 10/1985 | Gregory, Jr. | 194/203 |

FOREIGN PATENT DOCUMENTS

| | | | |
|---|---|---|---|
| 2441404 | 3/1974 | Fed. Rep. of Germany | 194/344 |
| 2724869 | 12/1978 | Fed. Rep. of Germany | 194/334 |
| 140600 | 11/1979 | Japan | 194/203 |
| 2124003 | 2/1984 | United Kingdom | 194/202 |

*Primary Examiner*—Joseph J. Rolla
*Assistant Examiner*—P. McCoy Smith
*Attorney, Agent, or Firm*—Cahill, Sutton & Thomas

[57] ABSTRACT

A coin handling apparatus contains a standard reference coin and a coin validation circuit that compares an inserted coin or slug with the reference coin as it passes through a chute toward a coin gate. The coin gate deflects the coin into a first path if the inserted coin is undersized and otherwise into a second path. The validation circuit produces a "valid coin" signal that indicates a match between the inserted coin and the reference coin, a "coin present" signal if any coin is being compared with the reference coin, and a photodetector output signal, all of which are applied as inputs to a surveillance circuit that analyzes those three signals and generates an output indicative of whether the inserted coin is being "strung", an output indicative of whether the inserted coin is a slug, and an "alert" signal that indicates whether either the coin is being strung or the inserted coin is a slug.

24 Claims, 12 Drawing Figures

FIG. 1
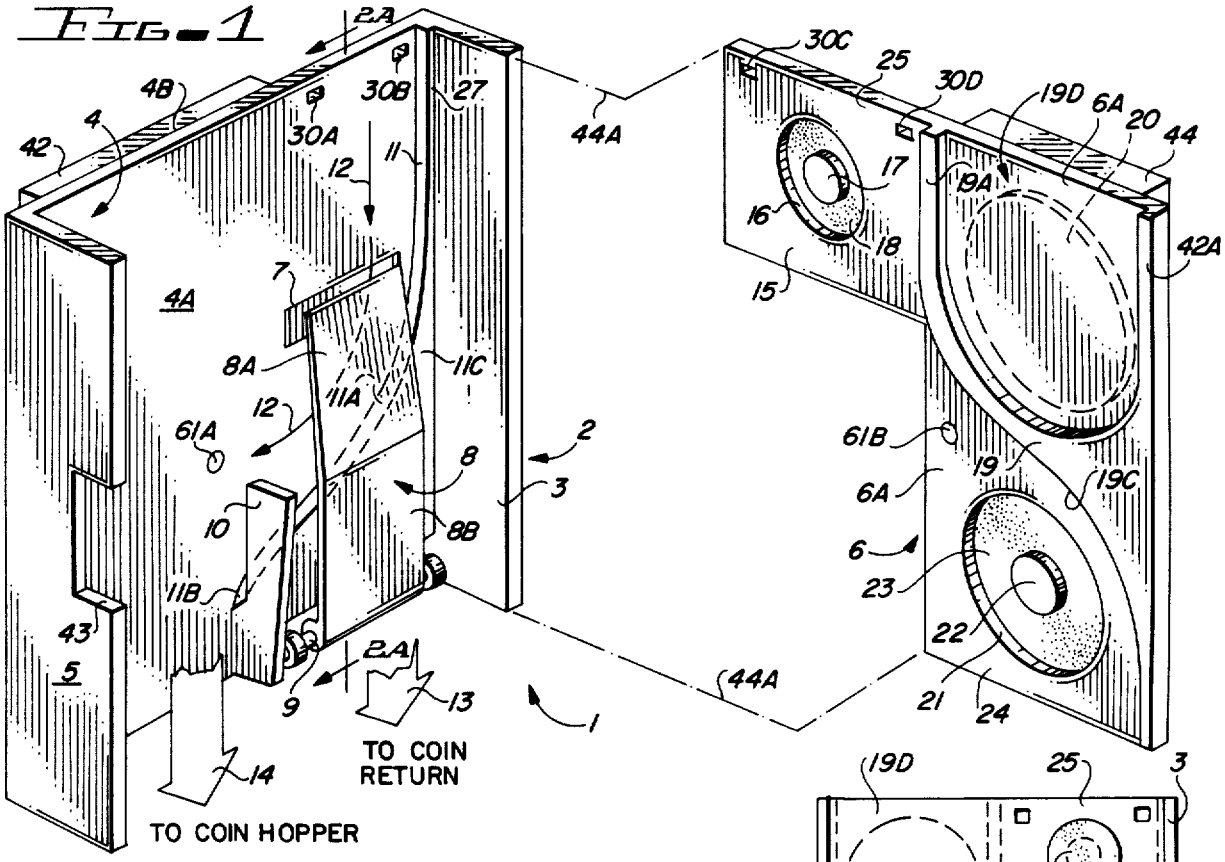
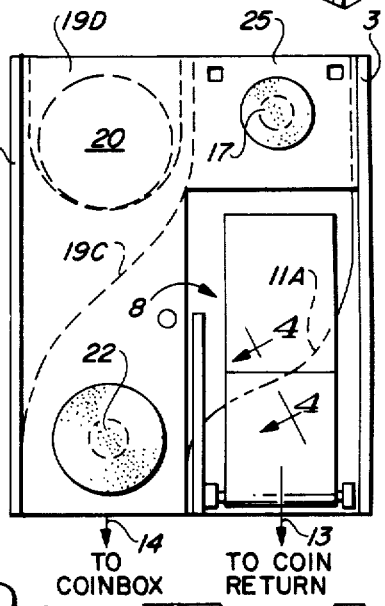
FIG. 3
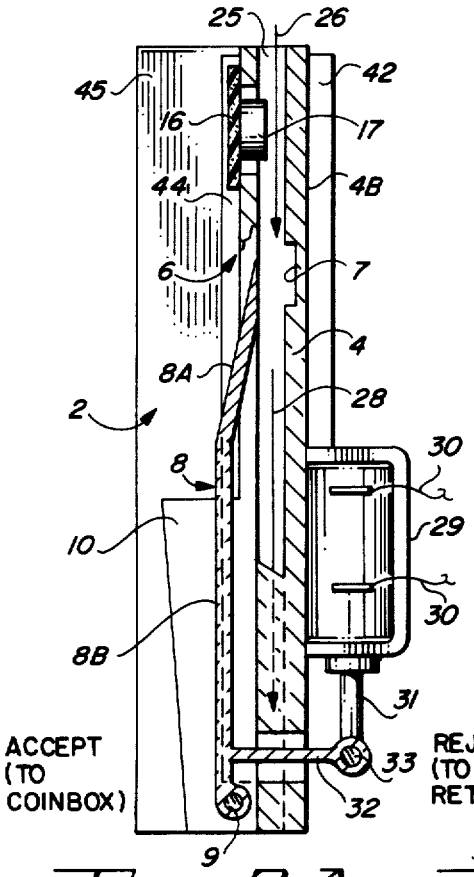
FIG. 2A
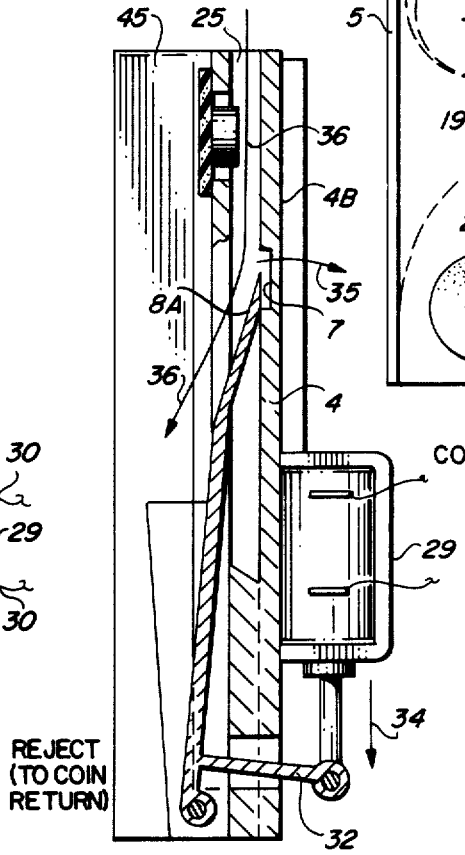
FIG. 2B
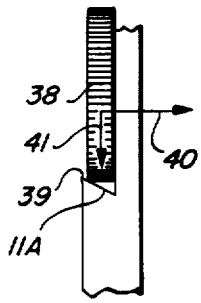
FIG. 4

COIN VALIDATION APPARATUS AND METHOD FOR DETECTING STRINGING OF COINS AND DISTINGUISHING VALID TOKENS OR COINS FROM SLUGS

BACKGROUND OF THE INVENTION

The invention relates to coin validation and coin handling equipment of the kind used in pay machines, such as gaming machines, vending machines, and the like.

Various slot machines, electronic poker games, electronic roulette games, and other "coin operated" machines typically include an apparatus for analyzing inserted coins to determine whether they are of the proper value, whether they are authentic, or whether they are acceptable tokens. Would-be cheats frequently attempt to obtain free plays, etc., by inserting slugs or unauthentic coins (such as foreign coins or coins of lesser value). Another approach used by would-be cheats is to attach a string to a coin and lower it into the coin receiving mechanism to actuate a sensor that initiates operation of the machine and then rapidly withdraw the coin back through the sensor to obtain yet another coin "credit" by such use of the string. This practice is commonly known as "stringing."

A variety of mechanical and electronic coin detection/validation apparatus are known in the art. Unfortunately, none of them are adequate to meet the present needs of casino operators in Nevada to eliminate or nearly eliminate cheating. As an example of a particularly troublesome problem that no presently available coin validation system has been able to solve numerous machines in Las Vegas accept "dollar tokens". Most of the casinos obtain supplies of dollar tokens which they then sell to patrons. The patrons then go from casino to casino, and insert tokens that they purchased in one casino in coin operated machines of another casino. The uniformity of the tokens obtained from different sources is less than perfect. Often, the coin sensing circuitry of a particular gaming machine will accept valid dollar tokens from one source but not another. This makes it necessary to "broaden" the tuning of the coin sensing circuitry so that it can accept all of the dollar tokens that are likely to be inserted into it. Unfortunately, the broadening of the tuning, which effectively reduces the sensitivity of the coin detection circuitry, causes the machines to accept counterfeit slugs.

Various "coin handling" apparatus that guide or deflect inserted coins into one coin path under certain conditions (for example, for a particular coin size and/or weight) otherwise and into another path, are known in the art. However, such coin handling machines have various shortcomings. Some of them are unduly expensive. Others are not easily interfaced or used in conjunction with state-of-the-art coin validation circuitry.

Commonly owned U.S. Pat. No. 4,441,602 (Ostroski et al.), incorporated herein by reference, discloses a state-of-the art coin validation circuit that includes first and second drive coils on a first printed circuit board on one side of a coin chute and driven by sinusoidal signals produced by an oscillator. First and second sense coils are disposed on a second printed circuit board on the opposite side of the coin chute and opposite to the first and second drive coils. A "reference coin" is disposed between the first sense coil and the first drive coil. An inserted coin passes through the coin chute between the second drive coil and the second sense coil, and a comparator compares the voltages induced the reference coin and then inserted in the first and second sense coils, respectively. If the induced voltages of the first and second sense coils match during the movement of the inserted coin, a valid coin signal is produced. U.S. Pat. No. 4,106,610 discloses the concept of sensing the presence of a coin moving down a chute by means of a coin presence sensor to determine if the inserted coin is a valid coin and generates a control signal that actuates a solenoid that then actuates a coin-deflecting gate that determines which of two paths the inserted coin will take. U.S. Pat. No. 3,998,309 discloses a coin-accepting device with coin position detectors and a counting circuit that cooperate to sense the sequence wherein the inserted coin passes the position detectors to determine the direction and velocity of movement of the inserted coin, and thereby detect whether "stringing" of the inserted coin is being practiced. U.S. Pat. No. 4,267,916 discloses use of optical detectors variously placed in the coin path to aid in detecting the sizes of the inserted coins. Other patents indicative of the state of the art include U.S. Pat. Nos. 3,285,382; 4,437,558; 4,243,133; and 4,298,116, the latter two being directed to anti-stringing devices. U.S. Pat. No. 4,267,916 discloses an array of optical sensors in the coin path of a coin identification system for determining the sizes, and hence the denominations of tokens, coins, etc.

Despite the availability of a variety of electronic coin validation devices that attempt to thwart would-be cheats, and despite the high market demand for sufficiently improved devices, casino operators and the like nevertheless suffer very large losses due to the inadequacy of presently available coin validation systems, because of the above difficulties in detecting well-made counterfeit tokens and slugs, also because of the difficulty of apprehending such cheats, and also because of the difficulties of successfully bringing legal action them. The difficulties of successfully bringing such legal action against cheats are due partly to the difficulty of obtaining acceptable evidence, such as photographs of the cheats triggered by the cheating activity, failure to obtain the inserted slugs and associate them with the apprehended cheat, etc. There remains an unmet need for an economical coin validation device, especially one that can distinguish both dollar tokens and silver dollar coins from slugs, and a coin handling mechanism that is economical, trouble-free, and compatible with a high-band width coin validation circuit of the type described in commonly owned U.S. Pat. No. 4,441,602.

SUMMARY OF THE INVENTION

Accordingly, it is an object of the invention to provide a low cost coin handling and validation system that can distinguish genuine coins or authorized tokens from lead slugs of similar weight, size, etc.

It is another object of the invention to provide a coin handling mechanism that is less expensive and effectuates more predictable coin sensing than coin handlers of the prior art, when used in conjunction with state-of-the-art electronic coin validation circuitry.

It is another object of the invention to provide a coin handling and validation system that provides a sufficiently high degree of selectivity that it can reliably accept a particular type of token (such as dollar tokens having slight differences in electrical characteristics due to differences therein that occur in different manufacturing batches from different sources), yet can reliably reject counterfeit slugs.

It is another object of the invention to provide a coin validation system that aids in collecting evidence that can be used in apprehending would-be cheats and providing evidence that can be used in legal prosecution of apprehended cheats.

Briefly described, and in accordance with one embodiment thereof, an electronic coin validation system including a coin handling mechanism provides a coin chute or path for inserted coins and supports electronic coin validation circuitry that compares signals produced by electromagnetic coupling across a reference coin disposed between a first drive coil and a first sense coil and by electromagnetic coupling across the inserted coin as it passes between a second drive coil and a second sense coil, and generates three signals, including a first signal indicative of the condition of an optical path across the coin chute being interrupted by the passing of a coin, a "valid coin" signal indicative of whether a predetermined level of inductive coupling between the first drive coil and the first sense coil has occurred for a minimum amount of time as the inserted coin passes between them, and a "coin present" signal indicative of the presence of electromagnetic coupling of at least a minimum level through any coin passing through the coin chute; these three signals are applied as inputs to a "surveillance circuit" that operates thereon to produce a "buffered" valid coin signal indicative of an adequate match of the inserted coin or token to the reference coin, a "slug" signal indicative of an inadequate matching between the inserted coin and the reference coin, a "stringing" signal indicative of improper coin travel direction in the chute or too long of a duration of the coin present signal, and an "alert" signal that indicates the condition of either a slug signal being generated or a stringing signal being generated. An access door switch is actuated when an access door to the inside of the machine (which door should only be opened by authorized personnel) is improperly opened, and sets a latch circuit that turns on a door light. The latch can be reset and the door light can be turned off only by generation of a valid coin signal resulting by inserting of a valid coin in the coin handling device. This prevents an attendant from paying out for a fraudulently set up jackpot condition. The chute of the coin handler includes a narrow, bottom guide surface on which the edge of the inserted coin slides or rolls. This surface is sloped at a relatively steep acute angle relative to a vertical back wall of the coin chute, so that an upward and backward component of force is applied to the inserted coin, causing it to be gently pressed against the vertical coin chute wall as the coin passes through the coin chute, avoiding "wobble" or vibration of the inserted coin as it passes through the coin chute, especially as it passes between the second drive coil and the second sense coil. First and second smooth, button-like coin guide surfaces are mounted on resilient membranes along the front vertical wall of the coin chute, providing a minute gap to the face of an inserted coin to allow free passage of authorized coins or tokens while also preventing the above mentioned wobble or vibration of the inserted coin, yet passing oversized slugs without jamming the coin chute. The avoidance of wobble or vibration of coins and tokens as they pass between the second drive coil and the second sense coil results in significantly increased accuracy of the comparisons with the reference coin by allowing the bandwidth of subsequent comparison circuitry, and hence the sensitivity thereof, to be increased.

BRIEF DESCRIPTION OF THE DRAWINGS

FIG. 1 is an exploded perspective view of a coin handler mechanism of the present invention.

FIG. 2A is a section view across section line 2A—2A of FIG. 1.

FIG. 2B is a section view similar to FIG. 2A, showing actuation of a coin gate by a solenoid of the coin handler of FIG. 1.

FIG. 3 is a front view of the coin handling mechanism of FIG. 1.

FIG. 4 is a section view taken along section line 4—4 of FIG. 3.

FIGS. 7A and 7B constitute a schematic circuit diagram of a surveillance circuit of the present invention.

DESCRIPTION OF THE INVENTION

Figure 5:
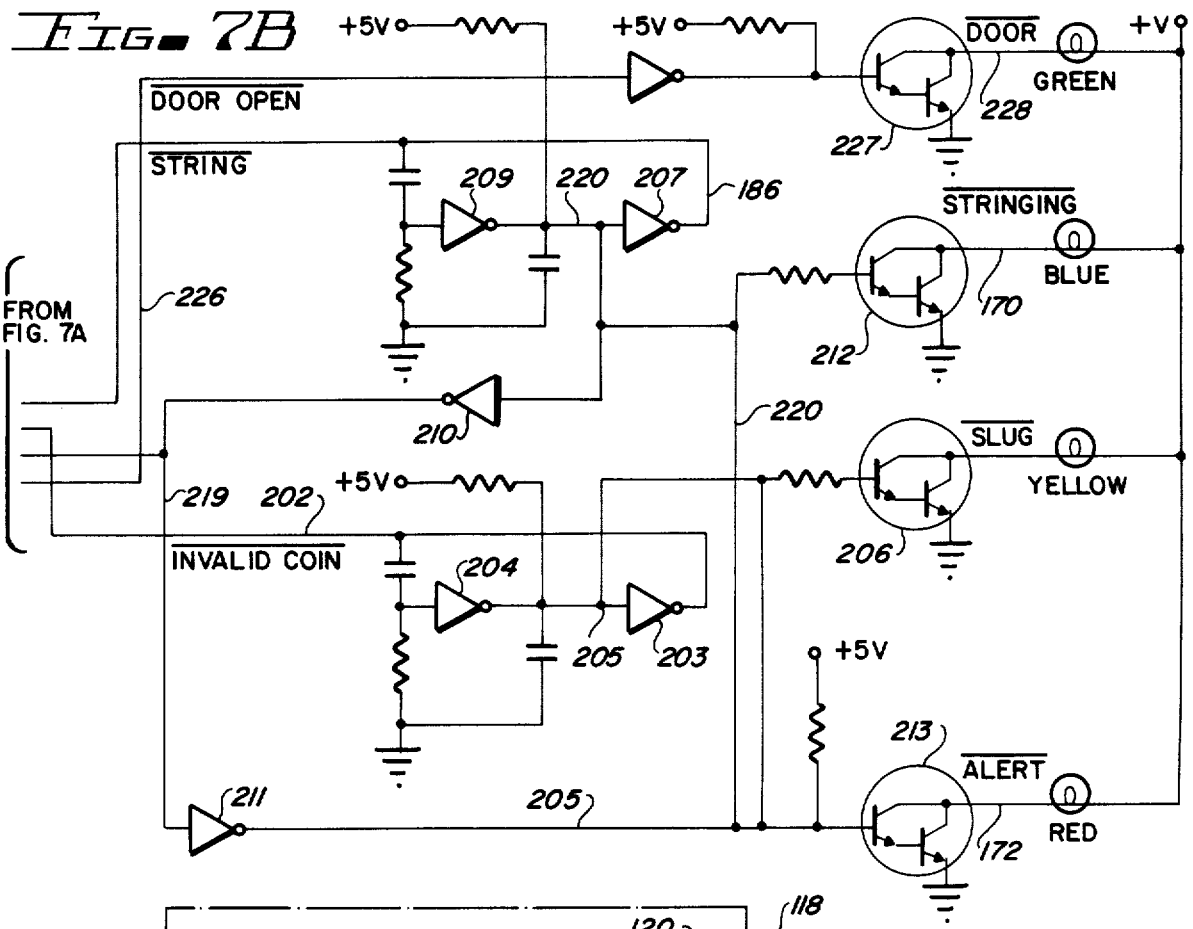
FIG. 5 is a portion of a drive circuit of an electronic coin validation circuit of the present invention.
Figure 5:
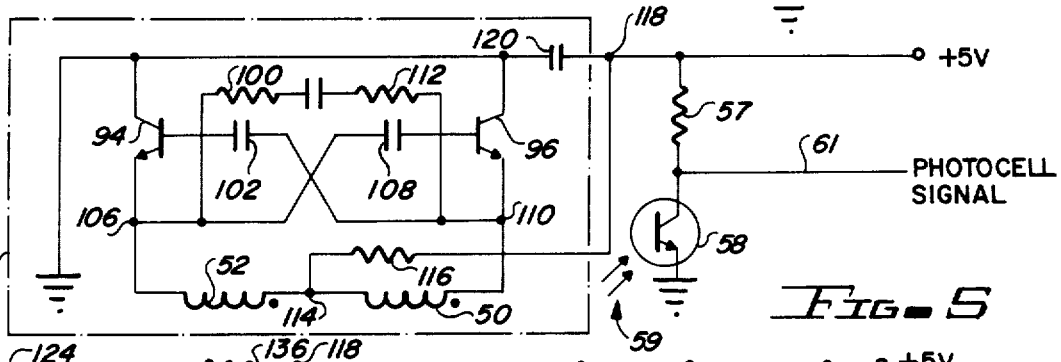

Referring now to FIGS. 1–4, an improved mechanical coin handler 2 includes a back housing section 2 having two side walls 3 and 5 connected by a back wall 4 having an inner surface 4A and a back surface 4B. A coin chute bounded by a narrow, S-shaped bottom wall 11 having a vertical upper portion, an intermediate curved portion 11A, and a lower vertical portion is defined by a raised (relative to flat vertical surface 4A) section 11C. The width of the lower coin chute boundary 11 is approximately 130 mils. At the upper portion of raised region 11C forms a lip 27.

A coin deflector vane 8 is attached at its lower end by a hinge 9 in a fixed pivoting relationship to back housing section 2. Coin deflecting vane 8 has a sloped upper surface 8A that extends over the lower coin chute boundary 11 so that the upper edge of sloped surface 8A extends slightly into a shallow recess 7 in the inner surface 4A of back plate 4. The lower outer portion of sloped surface 8A is connected to a thin web section 8 that is connected pivotally to stationary hinge or pivot pin 9. Pivot pin 9 is supported by side wall 3 and a bracket 10 that is attached to the inner surface 4A. Arrows 12 in FIG. 1 show the path of a coin inserted in a coin slot 25 (see FIG. 2A) at the top of coin chute of the assembled structure if the coin deflecting vane 8 is not deflected in response to a signal applied to a solenoid 29. Arrow 14 in FIG. 1, with arrows 12, defines a normal coin path to a coin hopper apparatus. Arrow 13 in FIG. 1 defines a second coin path to a coin return, taken by the inserted coin if it is deflected by coin deflecting vane 8.

Cutout 43 in sidewall 5 provides an opening into the structure for electrical cables to printed circuit boards that are mounted in the region 45 (FIGS. 2A and 2B) in the assembled structure, on which a cover will ordinarily be provided.

Figure 6:
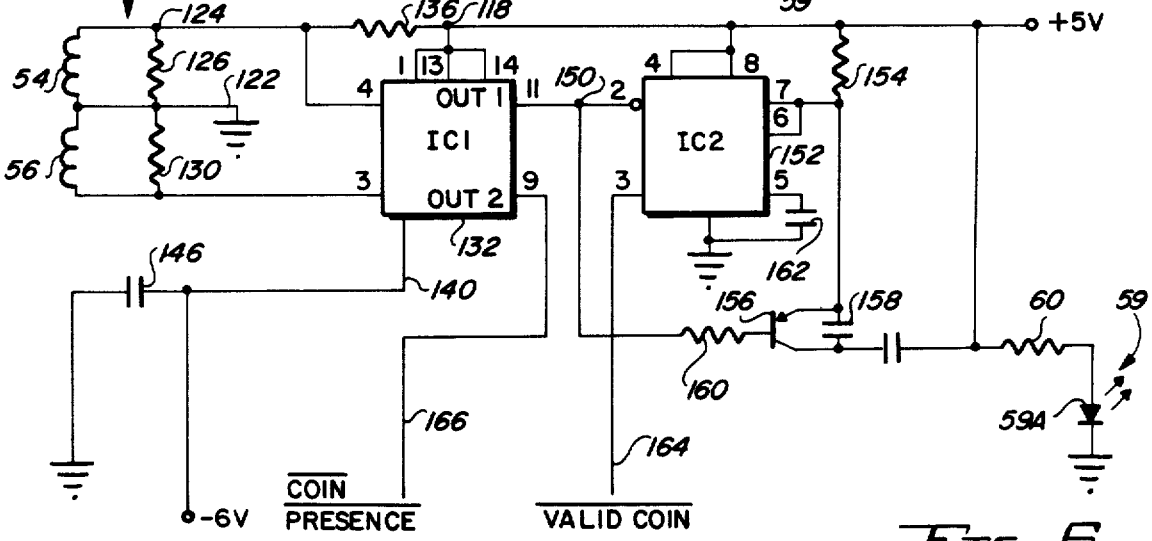
FIG. 6 is a portion of a comparison circuit used in an electronic coin validation circuit of the present invention.

The position of printed circuit board 42, on which the drive coils 50 and 52 and the oscillator circuit of FIG. 5 are disposed, is shown in FIGS. 1 and 2A. More specifically, the printed circuit board 42 is attached to the back surface 4B of back section 2. Printed circuit board 44, on which the sense coils 54 and 56 and the comparison circuitry of FIG. 6 are disposed, is attached to the front surface of front plate 6, as shown in FIGS. 1 and 2A. The drive coils and sense coils have the configuration shown in FIGS. 3 and 4 of incorporated-by-reference U.S. Pat. No. 4,441,602.

As indicated by dashed lines 44A in FIG. 1, front plate 6 is positioned within back housing section 2, so that the inner surface 15 thereof rests on shoulder 27, and an edge portion 42A of a raised section 19 of front plate 6 rests against inner surface 4A of back section 2, adjacent to the inner surface of side wall 5. The position of front plate 6 in the assembled coin handling apparatus 2 can be best seen in the section that is shown in FIG. 2A.

The inner surface 6A of the right hand portion of face plate 6, as it appears in FIG. 1, has a raised section 19 that defines an upper coin chute boundary 19C. The upper coin chute boundary 19C of front plate 6 and the lower coin chute boundary 11 of back housing section 2 define a narrow coin chute, the upper end 25 of which defines a coin insertion slot, as best seen in FIGS. 2A and 2B. The general "S" shape of the coin chute is perhaps best seen by reference to dotted lines 11A and 19C in FIG. 3, which define the upper and lower boundaries of the coin chute, hereinafter referred to as coin chute 11A, 19C.

Raised section 19 of front plate 6 also defines a narrow U-shaped edge surface 19A of a recess 19D bounded by the inside surface 6A of front plate 6. The recess 19D holds a reference coin 20 with which a coin inserted in slot 25 is electronically compared, as described herein and also in U.S. Pat. No. 4,441,602, issued Apr. 10, 1984, invented by the present inventors, commonly owned, and incorporated herein by reference. The region 45 in FIGS. 2A and 2B between the side walls 3 and 5 and the outer surface of front plate 6 define a region in which such circuitry, including printed circuit board 44 is housed.

Two smooth-surfaced, resilliently mounted coin guide "buttons" 17 and 22 are positioned in the coin chute 11A, 19C. The coin guide buttons 17 are resiliently mounted on rubber (or other suitable resilient material) membranes 18 and 23, respectively. The presently preferred embodiment of the invention is being designed to accept silver dollars and dollar tokens that have a thickness of about 100 mils. The thickness of the coin guide button 17 and 22 is selected to provide a 15 mil clearance between a dollar token passing through the coin chute and the surfaces of the coin guide buttons 17 and 22, if the opposite face of the dollar token is uniformly contacting the inner surface 4A of back plate 4.

FIG. 2A shows the salient details of solenoid 29, which is attached to the outer surface of 4B of back plate 4. Two electrical conductors 30 respond to the photocell detector output produced by the circuitry shown in FIG. 10, subsequently described, to cause solenoid plunger rod 31 to move downward in the direction indicated by arrow 34 in FIG. 2B if the inserted coin is undersized. This causes an arm 32 attached to coin deflecting vane 8 to pivot coin deflecting vane 8 in the direction of arrow 35 (FIG. 2B), causing the upper end of sloped surface 8A to move into recess 7, preventing the edge of the coin from striking the upper edge of sloped surface 8A. This happens before the inserted coin or token reaches the upper end of deflecting vane 8, so that the coin is deflected, as indicated by arrow 36, and does not pass through the path 14 to the coin hopper, but instead passes through the path indicated by arrow 13 to a coin return.

In accordance with an important aspect of the coin handler of the present invention, the portions of lower coin chute boundary 11 that are not vertical are sloped inwardly, by an acute angle of approximately 25 degrees (as measured with respect to the vertical inner surface 4A of back plate 4). This is best seen in FIG. 4, which is a section view taken along section line 4—4 of FIG. 3, wherein a coin 38 passing through the coin chute has its lower outer edge resting on a point 39 of the sloped lower coin chute boundary 11A. Reference numeral 41 designates the downward force of gravity on coin 38. It can be readily seen that this configuration results in a horizontal force, designated by arrow 40 tending to gently press the inner surface of coin 38 against the inner surface 4A of back plate 4 as the coin 20 passes through the coin chute 11A, 19C.

This is a very important feature, because it tends to prevent the inserted coin from wobbling and vibrating between the proposed vertical surfaces of the coin chute as it passes through the coin chute. At this point, it should be noted that the first and second drive and sense coils on printed circuit boards 42 and 44 are disposed on opposite sides of the reference coin 20. The second sense coil and the second drive coil between which the inserted coin 38 (FIG. 4) passes are located adjacent to the lower, vertical portion of the coin chute 11A, 19C, adjacent to the lower coin guide button 22, after the coin drops off the curved portion 11A of the lower coin boundary. By the time the inserted coin 38 reaches this point, it should have negligible wobble and vibration, as the sloped surface 11A should have eliminated essentially all such vibration and wobble.

The presence of the lower resiliently mounted coin button 22 adjacent to the second sense coil and drive coil further ensures that there is no vibration of the inserted coin at the most critical time, i.e., the time when it is being sensed by the second sense coil and the comparison circuitry shown in FIG. 6.

The circuit shown in FIG. 6 of incorporated-by-reference U.S. Pat. No. 4,441,602 is utilized in the coin validation circuit of the present invention. The oscillator is shown in FIG. 5, and is designated by reference numeral 47. The same reference numerals are used as in U.S. Pat. No. 4,441,602. The drive coils 50 and 52 are implemented on printed circuit boards as shown in FIG. 3 of U.S. Pat. No. 4,441,602. A portion of the comparator circuit shown in FIG. 6 of U.S. Pat. No. 4,441,602 is repeated in FIG. 6 herein, and is designated by reference numeral 47. Again, the same reference numerals are used as in U.S. Pat. No. 4,441,602. "Printed" coils 54 and 56 are used, as shown in FIG. 4 of U.S. Pat. No. 4,441,602.

The main differences in the coin validation circuitry of the present invention and coin validation circuitry U.S. Pat. No. 4,441,602 are that the photo detector circuit including resistor 57 and photo transistor 58 in FIG. 5, and a resistor 60 and a light emitting diode 61 in FIG. 6 are provided on opposite sides of the coin chute in FIG. 1, at the points designated by reference numerals 61A and 61B.

More specifically, in FIG. 5, resistor 57 is connected between the +5 volt supply conductor 118 and the collector of photo transistor 58, the emitter of which is connected to ground. Reference numeral 59 indicates light crossing the coin chute at points 61A and 61B, just before the coin reaches the drive coil 52 and the sense coil 56.

In FIG. 6, resistor 60 is connected between +5 volt supply conductor 118 and the annode of light emitting diode 61, the cathode of which is connected to ground. Again, reference numeral 55 indicates the light emitted by light emitting diode 61 through openings 61A and 61B in back section 2 and front plate 6, respectively, and impinging upon photo transistor 58.

In accordance with the present invention, a signal, referred to herein as the photocell signal, is produced on conductor 61, which is the junction between resistor 57 and the collector of photo transistor 58. Also, pin 9 of comparator 132, which is unused in the circuit of U.S. Pat. No. 4,441,602, now is connected to conductor 166, on which a signal COIN PRESENT* is produced.

The reference coin 20 of FIG. 1 is interposed between drive coil 50 and sense coil 54. The coin inserted in slot 25 passes between sense coil 52 and drive coil 56. As indicated above, the printed circuit boards 42 and 44 on which the circuitry of FIGS. 5 and 6 are provided are disposed on opposite sides of the coin chute llA, 19C, and also on opposite sides of the reference coin 20, as described more thoroughly in U.S. Pat. No. 4,441,602. The remaining circuitry in U.S. Pat. No. 4,441,602, is omitted as unnecessary to understanding the present invention.

Figure 8:
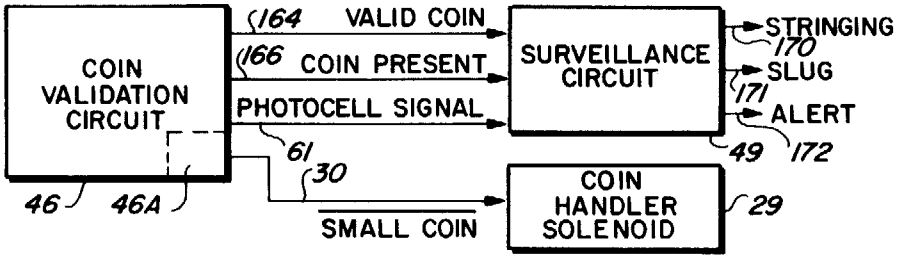
FIG. 8 is a block diagram illustrating the connections between the electronic coin validation circuit, the surveillance circuit, and the coin handler of the present invention.

Referring to FIG. 8, the relationship between the coin validation circuit 46, the surveillance circuit 49, and the coin handler of the present invention can be best understood by recognizing that the coin validation circuit 46 produces four output signals, including PHOTOCELL SIGNAL 61, COIN PRESENT* signal 166, VALID COIN signal 164, and the SMALL COIN signal 30, which are applied as inputs to the surveillance circuit 49.

Figure 10:
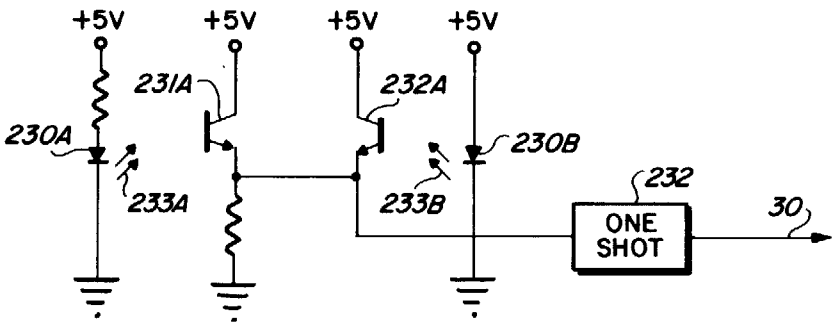
FIG. 10 is a diagram of a optical circuit for determining whether the inserted coin is of a minimum diameter and generating a signal to actuate the solenoid of FIG. 2B to deflect undersized coins.

FIG. 10 shows a circuit which produces the signals on one of conductors 30 (the other of which is connected to ground) to move the coin deflecting vane. Two photodiodes 230A and 230B are disposed on the back wall 4B of back section 2, and shine light 233A and 233B (FIG. 10) through openings 30A, 30D and 30B, 30C (FIG. 1) across the insertion slot of the coin chute, to phototransistors 231A and 232A (FIG. 10). If the inserted coin is large enough to interrupt both light paths 233A and 233B, a one shot circuit 232 (which can be a widely available 555 timer followed by a Darlington driver circuit) produces a solenoid actuation signal on conductor 30. Thus, any undersized coin or token that is inserted will be deflected to the coin return via path 13 of FIG. 1.

Surveillance circuit 49 operates on these signals to produce a "stringing" signal on conductor 170, a "slug" signal on conductor 171, and a "alert" signal on conductor 172. Several other signals, including a buffered version of the valid coin signal and a signal indicating whether a normally locked internal access door of a gaming machine has been opened, also are produced by the surveillance circuit 49.

Figure 7A:
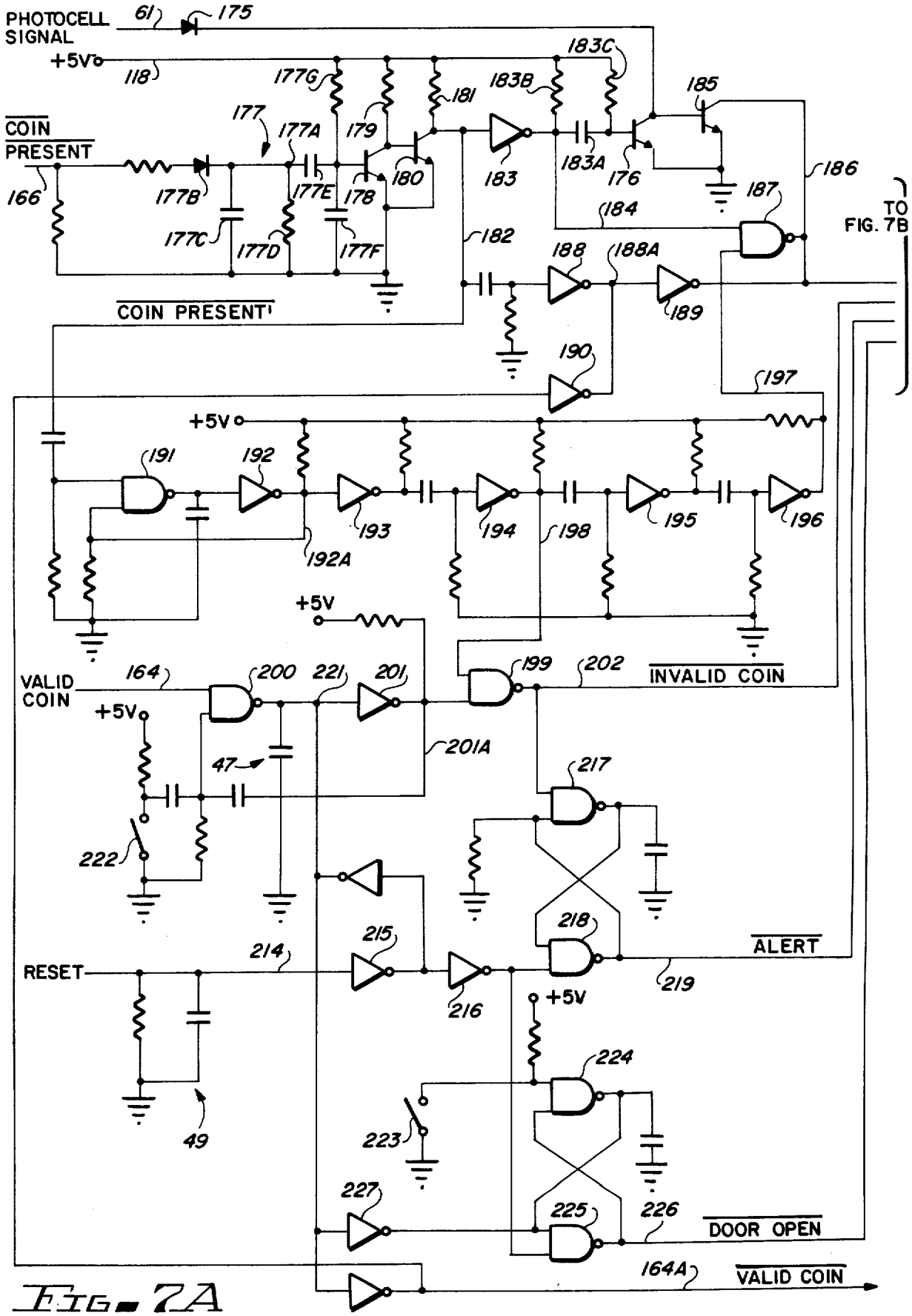

Referring now to FIGS. 7A and 7B, surveillance circuit 49 receives PHOTOCELL SIGNAL 61 and applies it by means of a diode 175 to the collector of an NPN transistor 176, the emitter of which is connected to ground and the collector of which is connected to a signal 186 on which a "stringing signal" is produced. The stringing signal on conductor 186 is applied to a pulse stretching circuit including inverters 207 and 209, a capacitor connected between conductor 186 and the input of inverter 209, and a resistor connected between the input of inverter 209 and ground, to stretch the stringing pulse to a length of about 120 milliseconds. The output of pulse stretching circuit 207, 209 is produced on conductor 208 and applied to the base of a Darlington transistor device 212, the output of which produces a stringing signal on conductor 170 and illuminates a blue light if a stringing condition is detected.

A COIN PRESENT signal 166 is applied to an amplifier circuit 177 including NPN transistor 178 and resistor 179. A negative change in the COIN PRESENT* signal 166 produces a negative change on node 177A that is coupled by capacitor 177E to amplifier 178, 179 to produce a full logic level swing at the collector of transistor 180. The resulting signal on conductor 182 is called COIN PRESENT*. The output of inverter 178, 179 is applied to the input of a second inverter including NPN transistor 180 and load resistor 181. The output of that inverter is applied by means of conductor 182 to the input of an inverter 183, the output of which is applied to two input NAND gate 187 and is capacitively coupled to the base of NPN transistor 176. The output of NAND gate 187 is connected to stringing signal conductor 186.

The coin present signal produced on conductor 182 is capacitively coupled to the input of a one shot circuit including two input NAND gate 191, the output of which is connected to an inverter 192. The output of inverter 192 is fed back to the other input of NAND gate 191, and is also applied to the input of a delay circuit. The delay circuit includes inverters 19, the output of which is capacitively coupled to the input of inverter 194. The output of inverter 194 is capacitively coupled to the input of inverter 195, the ouput of which is capacitively coupled to the input of inverter 196. The output of inverter 196 is connected by conductor 197 to the second input of two input NAND gate 187.

The VALID COIN signal 164 is applied to one input of two input NAND gate 200, the other input of which is connected to a manual coin switch 222, which can be depressed to simulate the VALID COIN signal to test the circuit. The output of NAND gate 200 is connected by conductor 221 to the input of an inverter 201. The output of inverter 201 is connected to one input of two input NAND gate 199, the output of which is connected to conductor 202, in which an invalid coin signal is produced. The other input of two input NAND gate 199 is connected by conductor 198 to the output of inverter 194.

Conductor 202 is connected to a pulse stretching circuit including inverters 203 and 204, that stretches the signal on conductor 202 to about 120 milliseconds. The input of inverter 204 is capacitively coupled to conductor 202 and the output is capacitively coupled to ground and is connected by conductor 205 to the input of inverter 203 and to the input of a Darlington transistor pair 206, the output of which is connected to conductor 171 to illuminate a yellow lamp if the presently inserted coin is determined to be a slug. The output of inverter 203 is connected to conductor 202.

A RESET signal 214 is applied to the input of an inverter 215, the output of which is applied to the input of inverter 216. The output of inverter 216 is applied to one input of a latch circuit 217, 218 and also to one input of a second latch 224, 225. The other input of latch 217, 218 is connected to conductor 202. The output of latch 217, 218 is connected by conductor 219 to the input of inverter 211 and the output of inverter 210. The input of inverter 210 and the output of inverter 211 are connected by conductor 205 to the junction between inverters 207 and 209 of the pulse stretching circuit that stretches the stringing signal on conductor 186.

The signal on conductor 219 represents a "alert" condition that occurs if either a stringing signal is produced on conductor 126 or a slug signal or a invalid coin signal is produced on conductor 202. The signal on conductor 205 is also applied to the input of Darlington transistor pair 206 described above and to Darlington transistor pair 213 to produce an output alert signal 172 that illuminates a red lamp if the aboved described alert condition is met.

The buffered VALID COIN* signal on conductor 164A can be utilized in various ways, for example, to actuate a gaming machine in which the coin validation system of the present invention is installed. (Note that an asterisk (*) is used herein to designate negative logic signals, as a "bar" is not available on the printer being used.)

Figure 9:
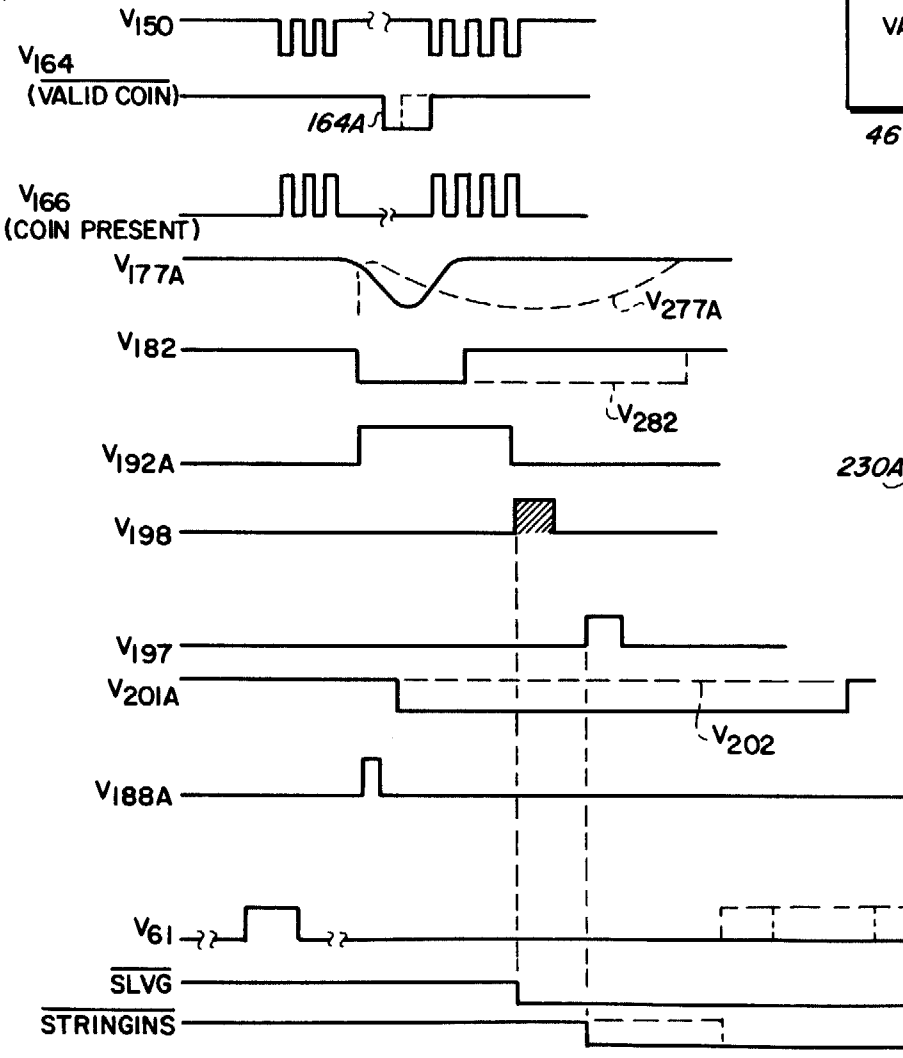
FIG. 9 constitues a set of waveforms useful in describing the operation of the surveillance circuit of FIGS. 7A and 7B.

To understand how the INVALID COIN* or slug signal on conductor 202 is generated in response to the VALID COIN* signal on conductor 164 and the COIN PRESENT signal on conductor 166, it will be helpful to realize that the circuit indicates that the inserted coin is a slug when the condition is met that there is a COIN PRESENT signal on conductor 166, which is reproduced on conductor 182 by a simple amplifier circuit including diode 177B, capacitor 177C, resistor 177D, capacitor 177E, capacitor 177F, and resistor 177G, and by transistors 178 and 180 and their associated load resistors 179 and 181, and the VALID COIN signal on conductor 164 is at a +5 volt level, as indicated by the $V_{164}$ waveform in FIG. 9.

The VALID COIN signal 164 produces a pulse 164A in FIG. 9 to indicated an electrical matching between the inserted coin 38 (FIG. 4) and the reference coin 20 (FIG. 1) if the electrical characteristics of the two match for a time interval that is at least 22 microseconds.

NAND gate 199 produces the slug or INVALID COIN* signal on conductor 202 if a coin present signal on conductor 166 produced by the above-mentioned one-shot including transistors 178 and 180, which produces on conductor 182 a signal that triggers a 10 millisecond one-shot including two input NAND gate 191 and inverter 192 and delayed by inverters 193 and 194 and the capacitor therebetween to produce a high level on conductor 198. This high level, combined with a high level on VALID COIN conductor 164, results in the voltage on conductor 201A being at a high level, and consequently produces a low level on conductor 202. That signal is stretched to approximately 120 milliseconds by the pulse stretching circuit including inverters 203 and 204. The logical complement of the signal on conductor 202 is applied to the base Darlington driver circuit 206 to produce the SLUG* signal on conductor 171, which illuminates a yellow lamp.

If the PHOTOCELL SIGNAL on conductor 61 is at a high level, i.e., +5 volts, this means that the light path 59 between light emitting diode 59A in FIG. 6 and the phototransistor 58 in FIG. 5 is interrupted by a coin in the coin chute. Normally transistor 176 of FIG. 7A will be in its on condition and will clamp its collector voltage to ground, causing transistor 185 to be off when the inserted coin is passing through the photocell light path 59 (FIGS. 5 and 6).

If the signal on conductor 184 of FIG. 7A is high, near 5 volts, this means that a coin is present between the sense and drive coils 52 and 56, located below the photocell consisting of light emitting diode 59A and phototransistor 58. The capacitor 183A and resistors 183B and 183C in FIG. 7A coupled to the output of inverter 183 form a 30 millisecond one-shot circuit, so that a high level on the COIN PRESENT signal on conductor 166 causes conductor 184 to go from 5 volts to ground, and turns transistor 176 off for about 30 milliseconds, until resistor 183C charges capacitor 183A back up and turns transistor 176 back on. For proper passage of a coin through the chute, in the downward direction, the photocell signal 61 will already have disappeared, so transistor 185 normally never turns on during passage of a proper coin downward through the coin chute. However, if the coin is being strung upward in the opposite direction by a cheat, then, during the 30 millisecond time period that transistor 176 is off, the photocell signal on conductor 61 will increase to 5 volts. This will turn transistor 185 on, clamping stringing signal conductor 185 to ground, ultimately turning on Darlington circuit 212 and generating a STRINGING* signal on conductor 170 and turning on the blue light.

Stringing signal conductor 186 can also be forced to ground by NAND gate 187. This occurs if the inserted coin is located between the drive coil 52 and the sense coil 56 for too long of a period of time, which can be about 18 miliseconds because when the COIN PRESENT* signal 166 is at 5 volts due to interruption of the photocell light path 59, a 10 millisecond one-shot circuit including NAND gate 191 and inverter 192 and a delay circuit including inverters 193, 194, 195 and 196 and the RC coupling circuits therebetween, produce a delayed signal on conductor 197. If the above-described signal appears on conductor 184 for a period longer than the delay through one-shot 191, 192 and the foregoing delay circuitry, both inputs of NAND gate 187 will be high, and the output on conductor 186 will be forced low, causing the stringing signal indication and turning on Darlington circuit 212 and illuminating the above-mentioned blue light.

If the slug or INVALID COIN* signal on conductor 202 occurs, i.e, a ground voltage appears on conductor 202, indicating a slug has been inserted, latch 217, 218 will be set, producing a ground signal on ALERT* conductor 219 causing Darlington circuit 213 to be turned on by inverter 211 and turning on a red alert lamp. Also, if a stringing signal is produced on conductor 186 by either of the foregoing conditions, conductor 219 will be forced low by the combined action of inverters 209 and 210, again setting latch 217, 218 to hold ALERT* conductor 219 low.

The latch 217, 218 can only be reset by means of a RESET signal applied to conductor 214.

If the access door of the machine is opened, then the door switch 222 closes and sets another flip-flop 224, 225 causing the DOOR OPEN* signal on conductor 226 to go to ground, turning on Darlington circuit 227, producing the DOOR* signal, and turning on a green lamp. Only a VALID COIN pulse such as 164 in FIG. 9 can reset flip-flop 224, 225 and turn off the green door lamp from outside of the machine. Applying a RESET signal to conductor 214 also can reset flip-flop 224, 225, but only from inside the machine. This circuit provides the advantage that if a thief manages to get the access door open, possibly with the aid of a dishonest employee, he may be able to manipulate the rotating disks of a slot machine to produce a jackpot display. However, the green door light is turned on by the opening of the access door. Therefore, if an attendant comes to pay the jackpot, he will see the green light on and will not pay the jackpot. If the thief inserts a valid coin, it will turn of the green door light, but will also erase the jackpot condition, which would ordinarily only be erased by the attendant after opening the access door, pressing a reset button to produce the reset signal on conductor 214, and thereby erasing the unpaid jackpot condition.

The logical operation of the surveillance circuit of FIGS. 7A and 7B has been explained above. The waveform shown in FIG. 9, however, may be useful to a careful evaluation of the operation of the circuit by one skilled in the art. The reference numeral subscripts of the waveform shown in FIG. 9, where appropriate, correspond to the conductors in FIGS. 7A and 7B on which the voltage waveforms appear.

While the invention has been described with reference to a particular embodiment thereof, those skilled in the art will be able to make various modifications to the described embodiment of the invention without departing from the true spirit and scope thereof. It is intended that all embodiments of the invention in which elements or steps are equivalent to those described herein in that they perform substantially the same function in substantially the same way to achieve substantially the same result are to be considered to be within the scope of the invention.

We claim:

1. An apparatus for validating coins inserted into a machine, the apparatus comprising in combination:

(a) a coin handling device including a coin chute through which an inserted coin falls, the coin chute having an upper coin insertion slot and a lower coin outlet, and also having a reference coin recess for holding a reference coin;

(b) an oscillator circuit driving first and second coils, the first coil being disposed on one side of the reference coin recess and the second coil being disposed on one side of the coin chute, and a comparison circuit including a third coil disposed on the other side of the reference coin recess opposite to the first coil, and a fourth coil disposed on the other side of the coin chute opposite to the second coil, and comparing means responsive to signals electromagnetically coupled from the first and second coils to the third and fourth coils, respectively, for producing a valid coin signal having a first duration indicative of the condition that an inserted coin having electrical characteristics matching those of the reference coin is passing between the second and fourth coils, and a coin present signal indicating the presence of any coin passing between the second and fourth coils; and (c) an interpretation circuit coupled to the comparing means for producing a stringing signal indicating that a coin is being strung through the coin chute, and a slug signal indicating that a coin passing between the second and fourth coils is a slug.

2. The apparatus of claim 1 wherein the interpretation circuit includes means responsive to the valid coin signal and to the coin present signal for producing the slug signal when the valid coin signal is at a level indicating that no coin electrically matching the reference coin is passing between the second and fourth coils and the coin present signal is at a level indicating that a coin is passing between the second and fourth coils.

3. The apparatus of claim 2 wherein the interpretation circuit further includes means responsive to the coin present signal for producing the stringing signal if the duration of the coin present signal exceeds a predetermined value.

4. The apparatus of claim 3 including a photocell circuit in the coin handling device above the second and fourth coils for producing a light beam across the coin chute that is interrupted when a coin passes through the coin chute and before a coin falling through the coin chute reaches the second and fourth coils, and means responsive to the photocell device and the coin present signal producing means for causing the stringing signal to have a level indicative of a stringing condition if the photocell signal occurs a predetermined amount of time after the coin present signal occurs.

5. The apparatus of claim 1 wherein the interpretation circuit includes means responsive to the slug signal and the stringing signal for producing an alert signal if either the slug signal or the stringing signal occurs.

6. The apparatus of claim 1 further including an access door switch that closes in response to the opening of an access door of the machine to the interior of the machine and also includes latch circuit means responsive to the access door switch for producing a door open signal and turning on a door open light when the access door is opened, the latching circuit means being resetable from outside of the access door only by inserting a coin that matches the reference coin into the coin insertion slot and causing a valid coin signal to be generated.

7. The apparatus of claim 1 wherein the coin chute is generally S shaped, and wherein the chute has a vertical upper portion at which the coin insertion slot is located and a lower edge portion that is sloped.

8. The apparatus of claim 7 wherein the sloped portion of the bottom surface of the coin chute forms an acute angle with a flat vertical wall of the coin chute to cause the weight of the inserted coin on the sloped portion of the lower portion to produce a small horizontal force component that gently urges one face of the inserted coin against a flat vertical wall of the coin chute to avoid coin vibration or jitter as the inserted coin passes through the coin chute.

9. The apparatus of claim 7 including first resilient coin guide means disposed in the vertical upper portion of the coin chute for producing a predetermined clearance between a face of the first resilient coin guide means and a face of an authorized coin inserted into the coin insertion slot to prevent initial coin jitter of the inserted coin and for yielding to an oversized coin or slug to prevent jamming of the coin chute.

10. The apparatus of claim 9 including second resilient coin guide means disposed beneath the sloped lower portion of the coin chute and a lower vertical portion of the coin chute for producing a predetermined clearance between the face of an authorized coin and a face of the second resilient coin guide means to prevent coin jitter as the coin passes between the second and fourth coils.

11. The apparatus of claim 10 wherein the first and second resilient coin guide means each include a smooth surfaced guide button mounted on a resilient membrane attached in fixed relationship to a vertical wall of the coin chute.

12. The apparatus of claim 7 wherein the length of the S shaped coin chute and the slope of the sloped lower portion thereof are selected to cause an authorized coin to pass through the choin chute within a predetermined range of times.

13. The apparatus of claim 7 further including coin size determining means disposed in the vertical upper portion of the coin chute for producing first and second signals indicative that an inserted coin has at least a predetermined diameter, and coin deflecting means responsive to the first and second signals for deflecting the inserted coin out of the coin chute before it reaches the second and fourth coils if the inserted coin has a diameter less than the predetermined diameter.

14. The apparatus of claim 13 wherein the coin size determining means includes first and second photocells disposed on opposite sides of the upper vertical portion of the coin chute creating optical paths both of which are interrupted if a coin of at least a predetermined diameter is inserted in the coin insertion slot, and control circuit means responsive to signals produced by the first and second photocells for producing a solenoid control signal if both of the first and second photocell signals do not occur essentially simultaneously, the apparatus including a solenoid connected to the coin deflection means to cause the coin deflection means to deflect an undersized coin out of the coin chute, and means for coupling the solenoid control signal to actuate the solenoid.

15. A method for validating coins inserted into a machine, the method comprising the steps of:

(a) inserting a coin in a coin handling device including a coin chute through which the inserted coin falls, the coin chute having an upper coin insertion slot and a lower coin outlet, the coin handling device also including a reference coin recess for holding a reference coin;

(b) operating an oscillator circuit driving first and second coils, the first coil being disposed on one side of the reference coin recess and the second coil being disposed on one side of the coin chute, and operating a comparison circuit including a third coil disposed on the other side of the reference coin recess opposite to the first coil, and a fourth coil disposed on the other side of the coin chute opposite to the second coil, and operating comparing means in response to signals produced by electromagnetic coupling from the first and second coils to the third and four coils, respectively;

(c) producing a valid coin signal that has a first duration indicative of the condition that the inserted coin has electrical characteristics matching those of the reference coin by passing the inserted coin through the coin chute and between the second and fourth coils;

(d) producing a coin present signal indicating the presence of any coin passing between the second and fourth coils;

(e) producing a stringing signal indicative that a coin is being strung through the coin chute by operating an interpretation circuit coupled to the comparing means in response to the coin present signal to produce the stringing signal if the duration of the coin present signal exceeds a predetermined value, and producing a slug signal indicative that a coin passing between the second and fourth coils is a slug in response to the valid coin signal and the coin present signal when the valid coin signal is at a level indicating that no coin electrically matching the reference coin is passing between the second and fourth coils and the coin present signal is at a level indicating that a coin is passing between the second and fourth coils.

16. The method of claim 15 including operating a photocell circuit in the coin handling device above the second and fourth coils to produce a light beam across the coin chute that is interrupted before the inserted coin passes between the second and fourth coils.

17. The method of claim 16 including causing the stringing signal to have a level indicative of a stringing condition if a photocell signal occurs a predetermined amount of time after the coin present signal occurs.

18. The method of claim 17 including producing an alert signal if either the slug signal or the stringing signal occurs.

19. The method of claim 15 further including operating an access door switch that actuates in response to the opening of an access door of the machine and also operating a latch circuit means responsive to the access door switch to produce a door open signal, and turning on a door open light when the access door is opened, the method including preventing the latching circuit means from being reset from outside of the access door except by insertion of a coin that matches the reference coin into the coin insertion slot and causing a valid coin signal to be generated in response to that coin.

20. The method of claim 15 wherein the coin chute is generally S shaped, and wherein the chute has a vertical upper portion at which the coin insertion slot is located and a lower edge portion that is sloped, the method including gently urging one face of the inserted coin against a flat vertical wall of the coin chute to avoid coin vibration or jitter as the inserted coin passes through the coin chute.

21. The method of claim 20 including producing a small horizontal force to effectuate the gentle urging, by means of a sloped portion of the bottom surface of the coin chute, which sloped portion of the bottom surface forms an acute angle with a flat vertical wall of the coin chute to cause the weight of the inserted coin on that sloped portion of the bottom surface to produce the small horizontal face.

22. The method of claim 21 including preventing initial coin jitter of the inserted coin by means of a first resilient coin guide means disposed in the vertical upper portion of the coin chute for producing a predetermined clearance between a face of the first resilient coin guide means and a face of an authorized coin inserted into the coin insertion slot, and causing the first resilient coin guide means to yield to an oversized coin or slug to prevent jamming of the coin chute.

23. The method of claim 22 including producing a predetermined clearance between the face of an authorized coin and a face of a second resilient coin guide means to prevent coin jitter as the coin passes between the second and fourth coils.

24. The method of claim 15 including determining whether the inserted coin has at least a predetermined diameter by means of first and second photocells disposed on opposite sides of the upper vertical portion of the coin chute and creating optical paths both of which are interrupted if a coin of at least the predetermined diameter is inserted in the coin insertion slot, and deflecting the inserted coin out of the coin chute before it reaches the second and fourth coils if the inserted coin has a diameter less than the predetermined diameter.

* * * * *